US009771672B2

(12) United States Patent
Ratsiri et al.

(10) Patent No.: US 9,771,672 B2
(45) Date of Patent: Sep. 26, 2017

(54) RE-WEAVING MACHINE AND RE-WOVEN TIRE CORD FABRIC

(71) Applicant: KORDSA GLOBAL ENDÜSTRIYEL IPLIK VE KORD BEZI SANAYI VE TICARET ANONIM ŞIRKETI, Kocaeli (TR)

(72) Inventors: Virush Ratsiri, Ayutthaya (TH); Niwat Chai-Itthiporn, Ayutthaya (TH); Pitak Bunprom, Ayutthaya (TH)

(73) Assignee: KORDSA GLOBAL ENDUSTRIYEL IPLIK VE KORD BEZI SANAYI VE TICARET ANONIM SIRKETI, Kocaeli (TR)

( * ) Notice: Subject to any disclaimer, the term of this patent is extended or adjusted under 35 U.S.C. 154(b) by 58 days.

(21) Appl. No.: 15/028,434

(22) PCT Filed: Jan. 12, 2015

(86) PCT No.: PCT/TR2015/000008
§ 371 (c)(1),
(2) Date: Apr. 10, 2016

(87) PCT Pub. No.: WO2015/126337
PCT Pub. Date: Aug. 27, 2015

(65) Prior Publication Data

US 2016/0237601 A1 Aug. 18, 2016

(30) Foreign Application Priority Data

Feb. 18, 2014 (TR) ..... 2014/01913

(51) Int. Cl.
*D03D 29/00* (2006.01)
*D03D 41/00* (2006.01)
(Continued)

(52) U.S. Cl.
CPC ..... *D03J 1/08* (2013.01); *D03D 1/00* (2013.01); *D03D 13/00* (2013.01);
(Continued)

(58) Field of Classification Search
CPC ..... D03D 29/00; D03D 33/00; D03D 41/00; D03D 45/50
See application file for complete search history.

(56) References Cited

U.S. PATENT DOCUMENTS 1,328,794 A * 1/1920 Ingham ..... D03D 41/00 139/11
1,336,741 A * 4/1920 Gielen ..... D03D 41/00 139/18
(Continued)

FOREIGN PATENT DOCUMENTS

CA 257823 A 2/1926

*Primary Examiner* — Bobby Muromoto, Jr.
(74) *Attorney, Agent, or Firm* — Gokalp Bayramoglu

(57) ABSTRACT

The invention relates to a re-weaving machine (1) and re-woven tire cord fabric which enables to weave the defected tire cord fabrics (B) to be woven again without being damaged after finishing process, re-woven tire cord fabric. The objective of the present invention is to provide a reweaving machine (1) which allows weaving the tire cord fabrics (B) again without getting damaged even in tire cord fabrics (B) with high linear densities and high weft densities, and which has blades (10) that can be adjusted according to the different cord fabric features.

6 Claims, 1 Drawing Sheet

(51) Int. Cl.

| | |
|---|---|
| ***D03J 1/08*** | (2006.01) |
| ***D03J 1/06*** | (2006.01) |
| ***D03D 1/00*** | (2006.01) |
| ***D03D 13/00*** | (2006.01) |
| ***D03D 15/00*** | (2006.01) |

(52) U.S. Cl.
CPC ..... *D03D 15/0011* (2013.01); *D03D 41/00* (2013.01); *D03J 1/06* (2013.01)

(56) References Cited

U.S. PATENT DOCUMENTS 1,361,530 A * 12/1920 Morris ..... D03D 41/00 139/442
1,431,348 A * 10/1922 Whittaker ..... D03D 45/50 139/246
1,445,493 A * 2/1923 De Neergaard ..... D03D 29/00 139/33
1,577,694 A * 3/1926 Danner ..... D03D 29/00 139/33
1,643,347 A * 9/1927 Mummert ..... D03D 41/00 139/311
1,718,832 A * 6/1929 Pierce ..... D03D 41/00 139/135
1,763,111 A * 6/1930 Walliser ..... D03D 29/00 139/11
1,833,588 A * 11/1931 Pierce ..... D03D 41/00 242/154
1,858,482 A * 5/1932 Churchill ..... D03D 29/00 139/29
1,901,250 A * 3/1933 Mattler ..... D03D 29/00 139/11
2,385,703 A * 9/1945 Hieber ..... D03D 29/00 139/1 R
2,449,691 A * 9/1948 Deal ..... D03D 29/00 139/1 R
2,476,640 A * 7/1949 Turner ..... D03D 45/50 139/247
2,505,443 A * 4/1950 Turner ..... D03D 45/50 139/247
2,799,296 A * 7/1957 Mills ..... D03D 41/00 139/317
3,016,068 A * 1/1962 Felix ..... D03D 41/00 139/11
3,724,513 A * 4/1973 Pfarrwaller ..... D03D 41/00 139/1 R
3,828,827 A * 8/1974 Witt ..... D03D 11/00 139/304
4,489,760 A * 12/1984 Long ..... D02H 11/00 130/101
4,581,794 A * 4/1986 Oldroyd ..... D21F 1/0054 28/141
4,887,656 A * 12/1989 Verbauwhede ..... D03D 1/00 139/454
5,351,722 A * 10/1994 Mamiliano ..... D03D 41/007 139/11
8,839,824 B2 * 9/2014 Cross ..... D06B 1/00 139/50
9,416,467 B2 * 8/2016 Cross ..... D06B 1/00

* cited by examiner

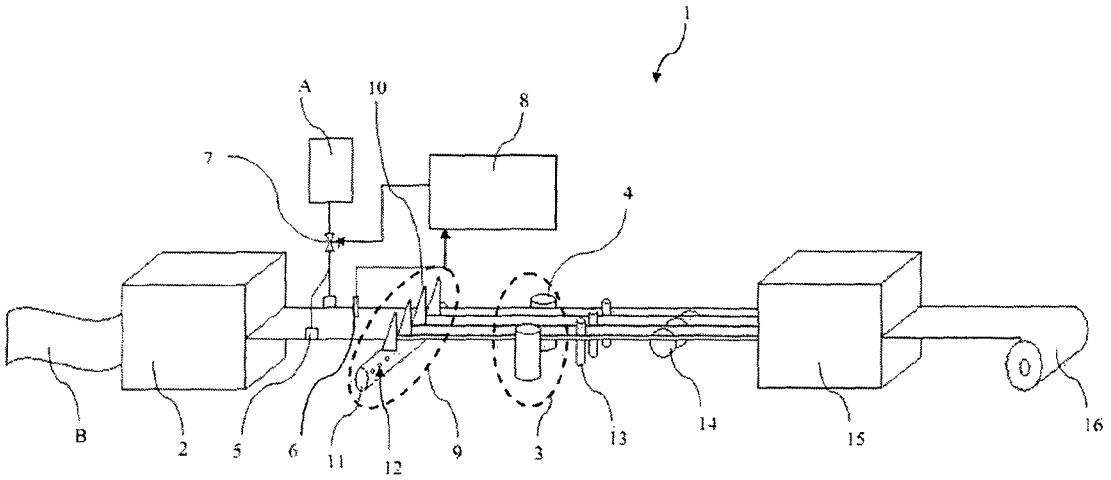
1
A
10
8
7
4
B
2
5
6
11
12
9
3
13
14
15
16

RE-WEAVING MACHINE AND RE-WOVEN TIRE CORD FABRIC

FIELD OF THE INVENTION

The invention relates to a re-weaving machine and re-woven tire cord fabric which enables to weave the defected tire cord fabrics to be woven again without being damaged after finishing process, re-woven tire cord fabric.

BACKGROUND OF THE INVENTION

Tire cord fabric is one of the main reinforcement material used in tire. Since the rubber cannot provide the sufficient force to meet all forces generated by the tire-road interaction, tire cord fabric is used to reinforce the mechanical features of the rubber. In tire cord fabric, twisted yarn and weft materials are used in weaving tire cords in order to acquire unidirectional cord fabric structure.

There are three main processes in tire cord fabric production.

The first one is twisting. Filament yarns (such as polyamid 6, polyamid 6.6, polyester, aramide, PEN, carbon fiber, rayon, fiber glass) are twisted as 50 to 800 tpm. Then, in order to provide tire cords as cable, the said twisted yarns are twisted either in opposite direction (SZ or ZS twist directions) or in same direction (SS or ZZ twist directions) together. The twist level depends on the material, the linear density of the yarn and the technical feature that is desired for the final product. Normally, the tire cords are twisted in S (or Z) and Z (or S) directions, and twisting process is performed in twisting machines.

The second process is called as weaving. This process comprises combining the twisted cords in order to create a fabric with twisted cords. It is performed in weaving machine by using weaving loom. There are two main components in weaving. These are twisted cords called as warp and weft. Warp is the main component of the tire cord fabric, and the weft cords are the support components which enable to form a whole by passing between the warp cords which are the main component. The loom is used for performing weaving process, and enables to pass the wefts between the parallel placed warps such that they will have 90 degree angle with the warps in order to form fabric structure. The number of the wefts in 10 centimeters is referred as PPD, and the number of warps in 10 centimeters is referred as EPDM. In general, EPDM level is much bigger in an ordinary fabric than the PPD level.

Mostly, this ratio (EPDM/PPD) is minimum 8 and it can be up to 12. The fabric manufactured in weaving machines is called as greige fabric.

Finishing is the third and last process in tire cord fabric production. Finishing process is performed in finishing unit. The fabric is coated with a proper adhesive which enables the connection between the cord and the rubber. Then the cords are dried and hot stretched at a certain temperature in order to provide the desired physical features. The final product is called as finished fabric.

As a result of these processes (twisting, weaving and finishing), defected products lack of technical features can be formed such as missing cord, filament cord, gap and fabric margin, folding, the cord getting loose from the fabric, and the fabric width being more or less than determined or weft density in all these cases, even if the fabric is ready to send to the customer, these problems should be eliminated. If these defects are not eliminated, the fabric may become scrap or can be sold as second class fabric.

In order to take care of the defect or some quality problems, the warp and the weft should be separated in order to cut the fabric and make the correction. That is, it should be woven again as it is required by the features of the fabric. This re-weaving process is performed with a unit called as "re-weaving machine".

In the state of the art, re-weaving is performed by passing the stages of let-off stand, pull roll, cutters, rotator blade, weaving loom, wind-up stand. Re-weaving applications start by taking the defected fabric roll to the let-off stand. The let-off stand which is the first stage of re-weaving process enables the fabric to be aligned properly in the inlet of the system. The fabric will progress on the pull rolls. Generally there are two rolls in each set of pull rolls. The fabric is drawn with tension from the let-off stand depending on the speed of the weaving machine generating reactive force based on fabric weight. Then the fabric moves to the cutter. A set of cutter usually has 50-60 blades, and each cutter an opening with about 30 $mm^2$ fixed with cutter holding rod. These cutters cuts weft yarn with about 20-30 cords/group depending on the fabric width, dtex level and weft density. Aside from these limits, the re-weaving machine cannot cut the wefts properly, and this causes the cords to break during process. Especially, when the weft density is above 6 PPD, cutting cannot be performed properly and the wefts cannot be collected with rotator blades.

Then the fabric is passed from the rotator. The rotator separates each cord of the fabric in opposite directions, and it is rotated by the electric engine in order to separate the remaining weft. During the rotational movement which the rotator makes, it creates vibrations to separate the weft remaining on the warp. In this stage, the cutter can cut the warp due to the rotational movement of the rotator which enables the warp cord to move upwards and downwards. If some cords contact the blade, they can get damages and break. Since only a set of cutting blades are used, cutting should be completed in single step; this may cause damage and thus loss in breaking strength. In case the finished fabric is re-woven, the current system cannot operate to remove the finished weft yarn properly, because the weft yarns are adhered to the wefts because of the adhesive coating in finishing process.

After the wefts are cut and collected in the rotator blade, the warps of the fabric are guided to the re-weaving machine for being woven again. This step provides a solution by restructuring the defected part of the fabric by starting over. The weaving machines used in this process can have a pleating machine which performs the weft rotation mechanically or any pleating machine that can operate at maximum speed which is approximately at 250 m/mn. Cutting and weft collection cannot be performed properly at higher re-weaving speeds. The final stage of the re-weaving process is to winding the rewoven fabric. All required parameters are controlled and confirmed at this step.

The re-weaving machine in current applications with the techniques known in the state of the art has four main deficits. The reweaving machines can operate in linear densities changing between 900 to 1700 dtex. Since the cord fabric has higher linear density than 1700 dtex in tire industry, the said fabrics cannot be rewoven properly. Second, in the current applications, the fabrics having weft density more than 8 PDD cannot be rewoven. The higher the pick density is, the more difficult to take the wefts from the processed fabric is. Thirdly, the weft material should be cotton or polyrayon or cotton with very low elongation. If the weft material has an elongation higher than 10/breaking value, the reweaving machine cannot cut the wefts, therefore the wefts cannot be cleaned from the fabric. Finally, the maximum machine speed can be 250 meters in a minute. Otherwise, weft cutting and cleaning cannot be performed. Since these limits cannot be overcome, reweaving machine cannot take the wefts from the fabric and reweaving process cannot be performed properly.

In addition to the technical capacity of the reweaving machine, the breaking strength of the fabrics rewoven with the current applications significantly drops because of the high and unstable friction during weft cutting process. This generally causes unwanted fabric features and causes too much scrap because of the cord breaking during process.

Due to the tight limitations in the current machine adjustment, reweaving cannot be performed for tire cord fabrics in all kinds properly. Especially, if the linear density of the warp is higher than 1700 dtex, reweaving cannot be performed. If the weft density is higher than 6 PPD, many problems such as the loss of breaking strength and the cords breaking during the process can be seen. Reweaving cannot be performed in weft densities higher than 8 PPD. Additionally, if the weft material has elongation at break value higher than 10%, the cutters cannot cut and thus reweaving cannot be performed properly. In case the current application is performed, the process speed of the reweaving cannot exceed 250 meters per minute.

In the previous art, since the cutters are placed after the pull roll, the tension of the warps cannot be kept stable, and causes the wefts to be cut improperly since there is no possibility to adjust the cutting blades in the holding rod.

Canadian Patent Document No CA257823 is known in the state of the prior art.

SUMMARY OF THE INVENTION

The objective of the present invention is to provide a reweaving machine which allows weaving the tire cord fabrics again without getting damaged even in tire cord fabrics with high linear densities and high weft densities.

Another objective of the present invention is to provide a reweaving machine which has blades that can be adjusted according to the different cord fabric features.

BRIEF DESCRIPTION OF THE DRAWING

FIG. 1 is a schematic view of the inventive reweaving machine.

DETAILED DESCRIPTION OF THE INVENTION

"A reweaving machine" developed to fulfill the objectives of the present invention is illustrated in the accompanying figures, in which The components shown in the figures are each given reference numbers as follows:

17. Reweaving machine
18. Let-off stand
19. Pull roll
20. Bobbin
21. Pneumatic brake
22. Barometer
23. Pressure control valve
24. Control unit
25. Cutting unit
26. Blade
27. Holding bar
28. Adjustment slot
29. Separator bar
30. Rotator blade
31. Weaving loom
32. Wind-up stand
A. Air source
B. Tire cord fabric The inventive reweaving machine (1) which is developed to eliminate the defects of the tire cord fabrics that are defectively woven by reweaving comprises at least one let-off stand (2) in which the fabric (B) regarded as defective is placed by the operator in order to be rewoven, at least one pull roll (3) which applies pulling force on the fabric (B) in order to enable the fabric (B) placed on the let off stand (2) to move, and which has at least two bobbins (4) that are vertically placed in order to maintain the uniform distribution of the tension along the width of the fabric (B), at least two pneumatic brakes (5) which enable the fabric (B) placed on the let off stand (2) to kept at a certain tension without getting damaged, which are placed on both sides of the let off stand (2) and operated with air pressure, at least one control unit (8) which enables to keep the fabric (B) in a desired tension value by adjusting the pressure control valve (7) which adjusts the air pressure of the pneumatic brakes (5) according to the data it receives from the barometers (6) placed on the brake, at least one cutting unit (9) which has at least one holding bar (11) having adjustment slots (12) thereon for each blade (10) in order to enable the system to operate properly without any quality problem in high linear density and high weft densities, at least two separator bars (13) which pass through the cutting unit (9) and which are placed vertical to the movement direction of the fabric in order to separate each strip of the fabric (B) that is become as strips from neighbor strips, at least two rotator blades (14) which are placed parallel to each other in order to remove the weft yarn adhered to the warp cord after passing through the separator bars (13), which enable the single warp cords to pass in opposite layers and directions by passing each warp one cord below and one cord above, at least one weaving loom (15) to which the warp cords are transferred after cutting blades (14) in order to rewoven properly, at least one wind-up stand (16) to which the rewoven fabrics are sent in order to be packed.

In the preferred embodiment of the invention, by means of the adjustment slots (12) which the holding bar (11) has, the fabrics (B) with linear density higher than 500 dtex and lower than 900 dtex can be rewoven. The technique can also be used for fabrics (B) with linear densities higher than 300 dtex and lower than 15000 dtex.

In the preferred embodiment of the invention, by means of the adjustment slots (12) which the holding bar (11) has, the fabrics (B) with weft density higher than 4 PPD and lower than 15 PPD can be rewoven. The invention can also be used for fabrics (B) with weft densities higher than 3 PPD and lower than 20 PPD.

Cotton, polyrayon, fiber glass and texturized nylon filling yarns with high elongation are used as weft material in preferred embodiment of the invention.

In the preferred embodiment of the invention, polyamide 6.6, polyamide 6, polyester, rayon, aramide, basalt, carbon fiber, fiber glass, polyethylene filaments or hybrid cord combinations of these materials are used as warp material.

In the preferred embodiment of the invention, the warp cords can be monofilament yarn or multifilament yarns or combinations thereof in hybrid cord form.

In the preferred embodiment of the invention, the cord density can be 50-200 cords per decimeter. More preferably, this invention operates with 60-150 warp cords per decimeter.

In the preferred embodiment of the invention, weft and cord yarns may have 50 to 800 twists per meter (tpm).

In the preferred embodiment of the invention, the weft and warp cords have Z or S direction twists in cable twisting and Z or S direction twists in layer twisting.

In the preferred embodiment of the invention, reweaving can be performed at speed up to 500 meters per minute by using pleating system. Furthermore, it can also be used in higher reweaving speeds such as 700 meters. The warps are held together by using pleating system and the ends of the weft yarns placed in 90 degrees of angle are prevented from being open. Therefore the wefts wind the warps at the edges of the fabric. The pleating system used in the inventive weaving machine (1) enables to work faster than a standard weaving machine.

The inventive reweaving machine (1) starts with the let off stand wherein the fabric (B) to be rewoven is placed. During process, two sets of pneumatic brakes (5) are applied on both sides of the let off stand (2) in order to control and improve the fabric (B) tension. Pneumatic brakes (5) are provided with air pressure, and controlled in accordance with the data received via the barometer (6) and by adjusting the pressure control valve (7) which adjusts the air pressure. Since the tension between the pull roll (3) and the let off stand (2) is kept fixed, the cutting unit (9) is placed before the pull roll (3) and thus the weft is enabled to be cut easily. In order to enable the system to operate properly without experiencing any quality problems in high linear density and high weft densities, the cutters in the inventive reweaving machine has a holding bar (11) having adjustable slots for each cutting blade (10). During cutting, the fabric (B) is cut in strips with the width of approximately 5 cm.

The pull roll (3) has two bobbing (4) which are vertically placed in order to maintain the uniform distribution of tension along the width of the fabric (B). Pneumatic brakes (5) and the vertically placed pull roll bobbins (4) prevent the cutting blades (10) which cause broken and damaged cords from contacting the warp.

In the inventive reweaving machine (1), after the fabric (B) is passed through the pull roll (3), the fabric strips formed during cutting stage move towards the separator bar (13). The separator bar (13) is comprised of two bars placed vertically which enable each strip is vertically separated from the neighbor strip. In this stage, the direction of separation and the process is vertical. By means of the vibration that is applied and the vertical separation, the separator bar (13) enables to eliminate the weft yarn in the fabric (B). The separator bar (13) makes easy to collect the wefts cut during process. Then the fabric (B) goes to the rotator blades (14).

There are two rotator blades (14) which are placed parallel to each other, in order to eliminate the weft yarn which is adhered to the warp cord after passing from the separator bars (13). In this process, each warp in the fabric (B) is separated from its neighbour such that it will pass one cord below and one cord above along the rotator blade (14). This causes the single warp cord to pass from the rotator blade (14) in opposite layer and direction.

The rotator blades (14) have the adjustable widths in order to maintain the quality during reweaving of different types of fabrics having different width, weft material, linear density and cord density. The speed of the fabric (B) and the speed of the rotator blades (14) in the system can be adjusted and controlled separately from each other through the control unit (8).

After rotator blades (14), each warp enters to the weaving loom (15) for being rewoven properly. Problems such as the spreading of the cords, opening of the cords or the cord being released from the fabric (B) can be prevented from the start with this reweaving process. Since air pleating systems are used with the abovementioned equipment and systems in the weaving looms (15)I the new technique allows the reweaving speed to increase up to 500 meters per minute. Finally, the rewoven fabrics go to the wind up stand (16) in order to be packed.

The inventive reweaving machine (1) allows the products, which cannot be rewoven or which have quality problems after being rewoven, to be rewoven. By means of the inventive reweaving machine (1), the tire cord fabrics the specifications of which are given below can be rewoven without experiencing the problems occurring in the previous art:

The linear density is 500 to 9000 dtex.

Weft materials are cotton, rayon, polyrayon and fiber glass which have weft with high elongation.

The weft density is 4 to 15 PPD (pick per decimeter).

The designing purpose of the invention is that is "easy to use" as the machine is easy to calibrate. When the style is changed, the corresponding parameters (fabric width, weft materials, greige or finished fabric etc) also change.

By means of the invention, it has working capacity in fabrics with high linear density (such as 9000 dtex) and high weft density (15 PPD). It will be possible to reweave finished fabrics (B) which is hard to reweave compared to greige fabrics.

Contrary to the previous art, the present invention has two rotator blades (14) which enable to completely eliminate the weft yarns during reweaving. Therefore, when it is compared with the previous art, the new technique has two different stages having three different equipments for eliminating the wefts from the fabric (B).

The invention claimed is:

1. A reweaving machine for the tire cord fabrics comprising:

at least one let-off reweaving stand;

at least one pull roll which has at least two vertically placed bobbins and applies pulling force on a fabric;

at least one cutting unit which has at least one holding bar having a plurality of adjustment slots installed thereon for each blade;

at least one weaving loom which reweaves fabric;

at least one wind-up stand which packs the rewoven the fabric and is characterized by:

at least two pneumatic brakes which are placed on both sides of the let-off reweaving stand, at least one barometer located on the two pneumatic brakes, at least one pressure control valve which adjusts the air pressure of the two pneumatic brakes, at least one tension control unit which adjusts the said pressure control valve, at least two separator bars which pass through the cutting unit and are placed vertical to the movement direction of the fabric that becomes strips after passing through the cutting unit, and at least two rotator blades (14) which are placed parallel to each other.

2. The reweaving machine of claim 1, wherein the plurality of adjustment slots installed on the holding bar enable the reweaving machine to reweave the fabric with a linear density that is higher than 300 decitex (dtex) and lower than 15000 dtex.

3. rhe reweaving machine of claim 1, wherein the plurality of adjustment slots installed on the holding bar enable the reweaving machine to reweave the fabric with a weft density that is higher than 3 Pick Per Decimeter (PPD) and lower than 20 PPD.

4. The reweaving machine of claim 1, wherein the at least two separator bars enable the removal of the plurality of weft yarns remaining on the fabric by means of the vibration which is applied and vertical separation.

5. The reweaving machine of claim 1, wherein the at least two rotator blades which have the adjustable widths in order to maintain the quality during reweaving of different types of fabrics having different width, weft material, linear density, and cord density.

6. The reweaving machine of claim 1, wherein a pleating system which allows high reweaving speeds up to 700 meters per minute by holding a plurality of warps together and preventing the plurality of weft yarns in 90 degrees of angle being open.

* * * * *